US006409322B1

(12) United States Patent
Ishitsu et al.

(10) Patent No.: US 6,409,322 B1
(45) Date of Patent: Jun. 25, 2002

(54) INK SUPPLY APPARATUS AND INK FILLING METHOD

(75) Inventors: Tomohiro Ishitsu; Yousuke Tatsumi; Kouji Terasawa, all of Mitaka (JP)

(73) Assignee: Copyer Co., Ltd., Tokyo (JP)

( * ) Notice: Subject to any disclaimer, the term of this patent is extended or adjusted under 35 U.S.C. 154(b) by 0 days.

(21) Appl. No.: 09/380,814

(22) PCT Filed: Mar. 12, 1998

(86) PCT No.: PCT/JP98/01027

§ 371 (c)(1),
(2), (4) Date: Nov. 23, 1999

(87) PCT Pub. No.: WO98/40216

PCT Pub. Date: Sep. 17, 1998

(30) Foreign Application Priority Data

Mar. 12, 1997 (JP) ..... 9-058101

(51) Int. Cl.[7] ..... B41J 2/175
(52) U.S. Cl. ..... 347/85
(58) Field of Search ..... 347/85, 86, 87, 347/49; 141/308, 309, 198

(56) References Cited

U.S. PATENT DOCUMENTS 4,999,652 A * 3/1991 Chan ..... 347/86
5,367,328 A * 11/1994 Erickson ..... 347/7
5,485,187 A * 1/1996 Okamura et al. ..... 347/85
5,790,158 A * 8/1998 Shinada et al. ..... 347/86

FOREIGN PATENT DOCUMENTS

| | | | |
|---|---|---|---|
| DE | 32 47 875 | * | 8/1983 |
| JP | 50-74341 | | 6/1975 |
| JP | 2-2013 | | 1/1990 |
| JP | 4-141445 | | 5/1992 |
| JP | 5-338196 | | 12/1993 |
| WO | WO-9840216 | * | 9/1998 |

* cited by examiner

*Primary Examiner*—Michael Nghiem
(74) *Attorney, Agent, or Firm*—Dellett and Walters

(57) ABSTRACT

An ink supply pipe 70 is inserted into a sponge 44 to reach a central or lower portion thereof where ink density higher. Thereby, the ink can be fed stably to a nozzle 42 and to reduce influence of the air introduced through an ink supply tube 60 and an ink supply pipe 70. Lateral holes 72 for ink discharge are provided on a side wall of the ink supply pipe 70. Thereby, a sufficient amount of the ink can be supplied from the lateral holes 72 of the supply holes 70, even when the sponge 44 is crushed upon insertion of the ink supply pipe 70 to narrow the tip orifice of the ink supply pipe 70.

12 Claims, 17 Drawing Sheets

INK SUPPLY APPARATUS AND INK FILLING METHOD

TECHNICAL FIELD

The present invention relates to an ink supply device for supplying an ink for an ink-jet type image formation apparatus, and a method for filling the ink.

BACKGROUND TECHNIQUE

Ink-jet type image formation apparatuses have been widely used for formation of an image on a recording medium. The ink-jet type image formation apparatus, for example, has a printing head having a nozzle for ejecting an ink, and a carriage reciprocating in a prescribed direction with the printing head held thereon. The maximum amount of the ink stored in the printing head is limited to avoid an excessive weight of the reciprocating carriage.

To solve this problem, ink supply device 10 as shown in FIG. 17 is used in which ink tank 12 of a large capacity is placed separately from the carriage (not shown in the drawing), and from this ink tank 12 an ink is supplied through ink supply tube 14 to printing head 16. Printing head 16 has ink pool 20 therein for storing liquid ink (raw ink) 18. This ink 18 stored in ink pool 20 is ejected from nozzle 22. Ink pool 20 of printing head 16 may be constructed from a hard wall, or a soft bag expandable by a plate spring from the periphery.

In the ink pool constructed of a hard wall, the volume of air in ink pool 20 changes with the use of the ink. The volume of the air changes also depending on the environmental temperature. As the results, the pressure exerting on the ink stored in ink pool 20 varies to vary the amount of the ink to be fed to nozzle 22. Therefore, the variation of the use of the ink and the environmental temperature will cause variation of the amount of ink ejection through nozzle 22, which can deteriorate the image quality. Further, since printing head 16 moves with the carriage, the ink in ink supply tube 14 is moved by inertial force to vary the amount of the ink stored in ink pool 20 to vary the air volume in ink pool 20. In this case also, the image quality can be deteriorated by variation of the amount of ejection of the ink.

On the other hand, in ink pool 20 constructed from a soft bag expandable by a plate spring, the amount of the air in the tank is controlled by the plate spring to decrease the variation thereof to stabilize relatively the amount of the ink ejected from nozzle 22. However, the use of the plate spring and the soft bag complicates the structure of ink tank, disadvantageously.

In the both cases of the solid wall-surrounded ink pool and the soft bag type ink pool an impurity may contaminate the ink in operation of connection or disconnection of ink supply tube 14, or exchange of ink tank 12. The impurity contaminating the ink can reach nozzle 22 to clog nozzle 22, disadvantageously.

Furthermore, the liquid surface level of the ink stored in ink tank 12 goes down with consumption of the ink, so that the vertical distance between the liquid surface level and nozzle 22 becomes larger with consumption of the ink, causing variation of the amount of the ink ejected through nozzle 22 to deteriorate the image quality. This ink level lowering can be prevented by making ink tank 12 flat to decrease the depth of the ink, but it requires a larger space therefor. Otherwise, a float or a valve may be provided in ink tank 12, or a negative pressure-generating mechanism may be provided in the printing head to decrease the variation of the amount of the ink ejected through nozzle 22. With any of the above techniques, the construction becomes complicated, disadvantageously.

For filling the ink for the first time from ink tank 12 into ink supply tube 14, the ink is usually sucked by a head-recovering suction pump for the printing head recovery, or sucked by a negative pressure generated by connection of a negative pressure-generating means such as a syringe to the outlet of ink supply tube 14.

The negative pressure generated by the head-recovering suction pump is not sufficient, so that the suction operation should be repeated several times for filling the ink into ink supply tube 14, which takes a long time. When the negative pressure-generating means is used for filling the ink into ink supply tube 14, the operation is not simple, and may cause soiling of hands and other disadvantages.

DISCLOSURE OF INVENTION

The present invention intends, under the above circumstances, firstly to provide an ink supply device which is capable of supplying the ink in an stable amount to eject through the nozzle. The present invention intends secondly to provide an ink filling method for filling smoothly an ink into an ink supply tube.

In an ink-jet type image formation apparatus having a carriage reciprocating in a prescribed direction and forming an image by ejection of ink on a recording medium, the ink supply device of the present invention for achieving the above first object comprises a printing head having a nozzle and being mounted on the carriage, an ink tank for storing the ink to be supplied to the printing head, and an ink supply tube for supplying ink from the ink tank to the printing head, wherein (1) the printing head has a built-in porous mass of an open-cell structure communicating with the nozzle, and
(2) the ink supply tube is connected at the one end to the porous mass, and the ink tank, the ink supply tube, and the printing head are connected hermetically.

The porous mass of an open-cell structure means the one which has holes communicating with each other.

The ink supply device may have (3) an ink supply pipe which is connected to the one end of the ink supply tube and is inserted into the porous mass.
(4) The tip of the ink supply pipe may be inserted into the center portion of the porous mass or into the portion thereof nearer to the nozzle than the center portion.
(5) The ink supply pipe may have an ink supplying through-hole on the side wall thereof.
(6) The porous mass may be the one which is capable of absorbing the pressure variation in the ink supply tube by capillarity.

The ink tank may comprise (7) an open tank which contains the ink with the surface of the ink open to the atmospheric air, and
(8) additionally a closed ink tank which is placed above the open ink tank, storing the ink in a closed state, and having a connection pipe extending vertically to come into contact with the ink in the open tank.

The open ink tank (9) may be placed such that the surface level of the stored ink is lower than the position of the nozzle of the printing head.

The ink supply device

(10) may have a joint member which is attached to the tip end of the ink supply tube and connects the ink supply tube detachably and hermetically to the printing head.

The ink supply device

(11) may have a joint housing room formed in the carriage for housing the joint member.

The joint housing room

(12) may be provided in the same number as the number of the joint members connected to the printing head mounted on the carriage.

The ink supply device

(13) may have a cover for covering the joint housing room.

The joint member may have

(14) a first connection orifice for connection with the tip portion of the ink supply tube,

(15) a second connection orifice for connection of the ink supply pipe,

(16) a third connection orifice separated from the first and second openings, and further

(17) a sucking device connected to the third connection orifice to suck the ink.

The sucking device may have

(18) an ink-filling adapter to be inserted into the third connection orifice to communicate with the first connection orifice and not to communicate with the second connection orifice.

(19) The third connection orifice may have a groove extending in the direction of insertion of the ink-filling adapter on the inside wall thereof, and

(20) the ink-filling adapter may have, on the outer face thereof, a rib to fit to the groove.

The ink filling method of the present invention for achieving the above second object comprises ink filling steps:

(21) connecting a sucking device for sucking of the ink with the third connection orifice, closing the second joint opening of the joint member, and

(22) sucking the ink with the sucking device to fill the ink into the ink supply tube.

BEST MODE FOR CARRYING OUT INVENTION

The embodiments of the present invention are explained below by reference to drawings.

A first embodiment of the ink supply device is explained by reference to FIGS. 1–3.

Figure 1:
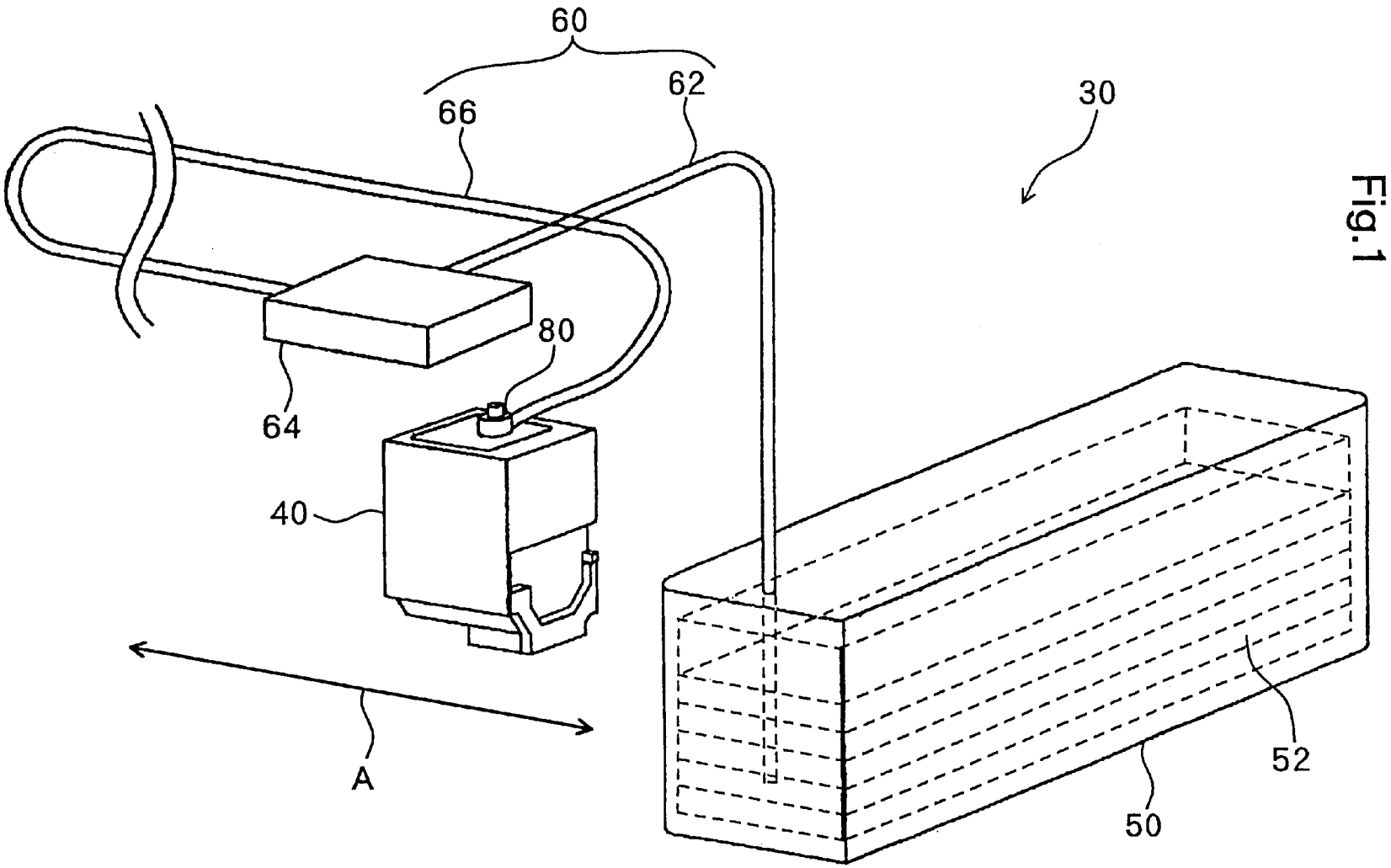
FIG. 1 is a perspective view showing schematically the constitution of an ink supply device of a first embodiment of the present invention.

FIG. 1 is a perspective view showing schematically the constitution of an ink supply device of a first embodiment of the present invention. FIG. 2 is a schematic view of the printing head of the ink supply device shown in FIG. 1 with a portion thereof broken away. FIG. 3 is a schematic view of an ink supply pipe inserted into the printing head shown in FIG. 2.

Ink supply device 30, which is incorporated into a conventional ink-jet type image formation apparatus (not shown in the drawing), has printing head 40 mounted on a carriage (not shown in the drawing) reciprocating in arrow-A direction. Printing head 40 ejects, while reciprocating in arrow-A direction, an ink through nozzle 42 to form an image on a recording medium (not shown in the drawing). Ink supply device 30 has also ink tank 50 for storing ink 52 to be supplied to printing head 40, and ink supply tube 60 for supplying ink 52 to printing head 40. Ink supply tube 60 includes first tube 62 immersed into ink 52, and second tube 66 connected to first tube 62 by connector 64 and connected also to printing head 40 with each of the connection portion sealed hermetically.

The ink tank 50 is placed such that the surface level of ink 52 in ink tank 50 is lower than nozzle 42 of printing head 40. With ejection of the ink through nozzle 42, ink 52 is sucked up from ink tank 50 by capillary force (capillarity) of the orifice of nozzle 42 to be supplied through ink supply tube 60 to printing head 40.

Figure 2:
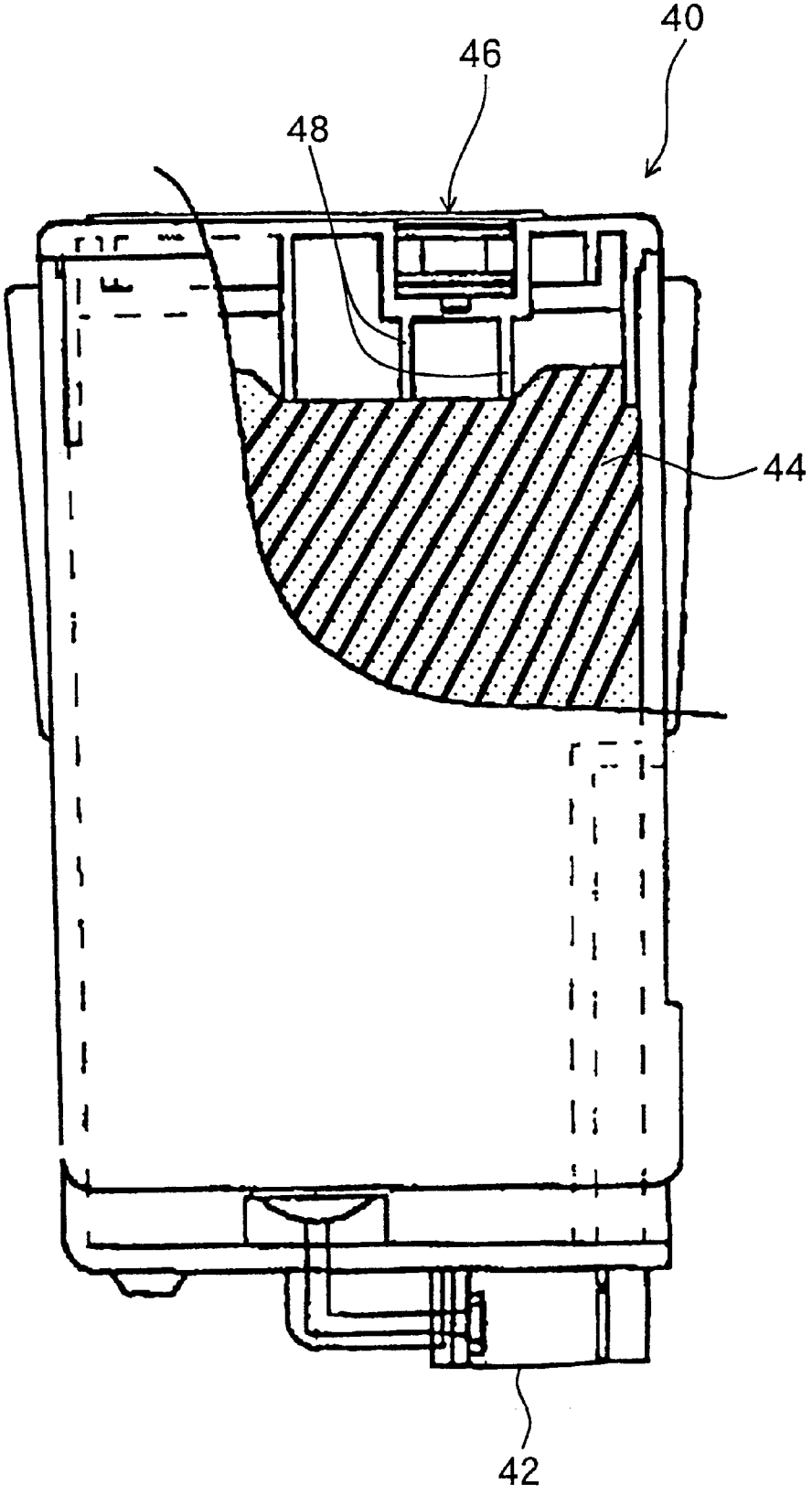
FIG. 2 is a schematic view of the printing head of the ink supply device shown in FIG. 1 with a portion thereof broken away.
Figure 3:
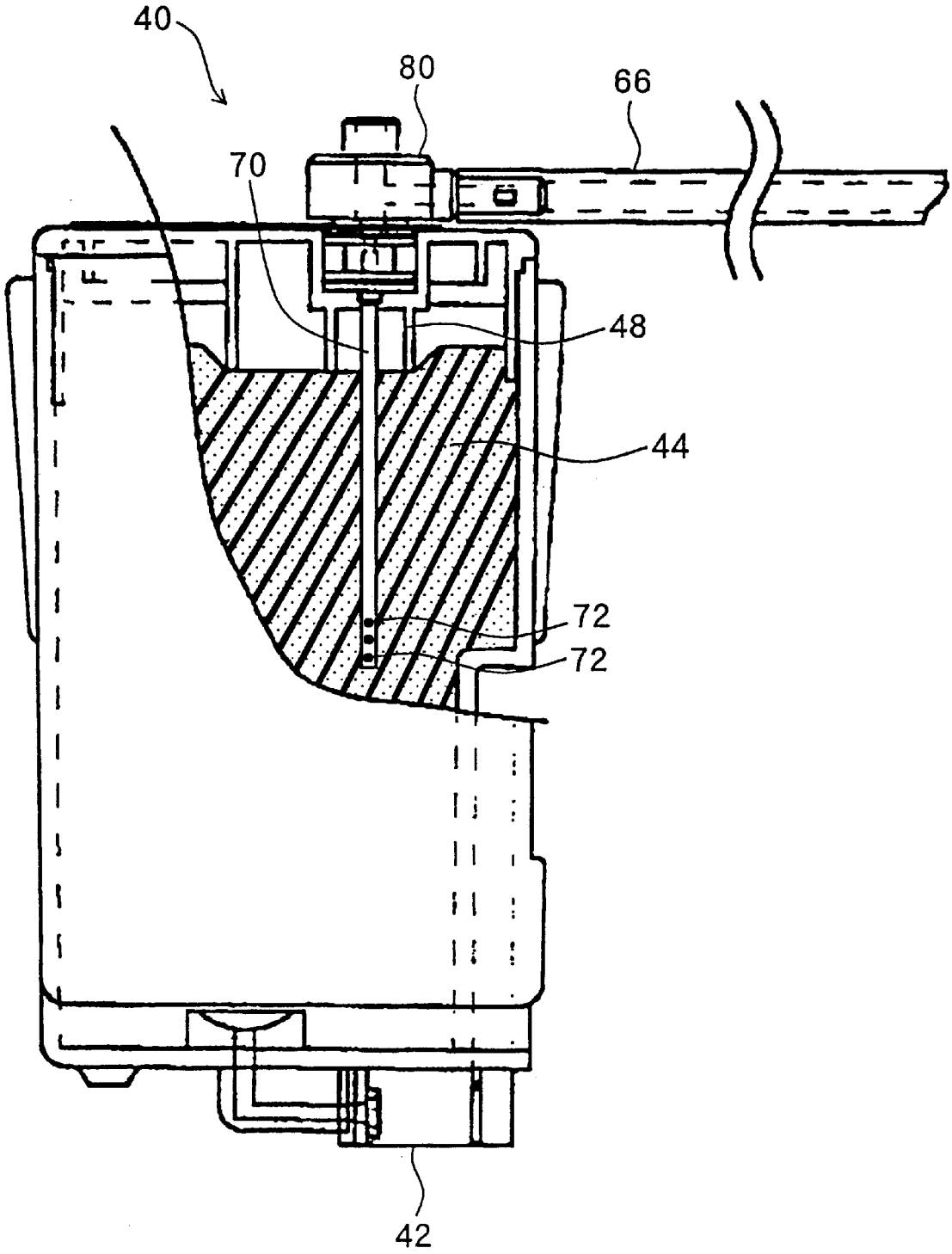
FIG. 3 is a schematic view of an ink supply pipe inserted into the printing head shown in FIG. 2.

Printing head 40 has sponge 44 (an example of the open-cell porous mass in the present invention) built therein as shown in FIGS. 2 and 3. The ink absorbed by sponge 44 is supplied to nozzle 42 formed in the lower portion of printing head 40. Ink is ejected through nozzle 42 by heat generation of a heater (not shown in the drawing) in correspondence with a signal from the main body of the ink-jet type image formation apparatus.

In supplying ink 52 from ink tank 50 through ink supply tube 60 to printing head 40, cover 46 is removed from the entry of ink supply metal pipe 70 as shown in FIG. 3, and ink supply pipe 70 connected through joint member 80 to second tube 66 is inserted into sponge 44. Thereby, printing head 40 and ink tank 50 communicate with each other, and ink 52 in the ink tank is supplied through supply tube 60 to printing head 40.

Ink supply pipe 70 is inserted into the central or lower portion of the sponge 44 where the ink density is higher. The supply of the ink by ink supply pipe 70 into the portion of high ink density in sponge 44 enables stable supply of the ink, and reduces the influence of the air introduced from ink supply tube 60 and ink supply pipe 70. On the side wall of ink supply pipe 70, lateral holes 72 are formed for ink introduction. Thereby, even if the tip opening of ink supply pipe 70 is narrowed by crush of sponge 44 by insertion of ink supply pipe 70 into sponge 44, necessary amount of ink can be supplied through lateral holes 72 of ink supply pipe 70.

During the printing, ink supply tube 66 connected to printing head 40 moves in reciprocation in arrow-A direction with the reciprocating movement of printing head 40 mounted on a carriage (not shown in the drawing) in arrow-A direction. Therefore, the pressure of the ink applied to printing head 40 will vary by an inertial force exerting to the ink in ink supply tube 66. This pressure variation can make instable the amount of the ink ejected through nozzle 42, deteriorating the image quality. However, the pressure variation is offset by the capillarity of sponge 44, which stabilizes the amount of the ink ejected through nozzle 42 and prevents deterioration of image quality.

In the upper portion of printing head 40, rib 48 extending inside is formed. This rib 48 presses sponge 44. Thereby, sponge 44 is held in a compressed state in printing head 40. Further, nozzle 42 is placed below joint member 80. Consequently, the density of the absorbed ink is higher in the portion near to nozzle 42 than other portions in the sponge 44.

Nozzle 42 has, at the tip portion, fine orifice holes (not shown in the drawing) of several tens of microns in the hole diameter, which induces an ink-holding power of not less than −250 Aq as a water head by the surface tension. This compensates immediately the slight decrease of the pressure in printing head 40 caused by consumption of the ink by ink ejection from nozzle 42. Further, the ink can be sucked up from the open ink face at a negative water head position to printing head 40.

Furthermore, any impurity, which may introduced into ink supply tube 60 or ink head 40 in exchange of the ink tank or exchange of printing head 40 by detaching joint member 80 from printing head 40, will be removed by sponge 44 serving as a filter to prevent failure of ink ejection by clogging of nozzle 42.

Next, a second embodiment of the present invention is explained by reference to FIGS. 4 and 5.

Figure 4:
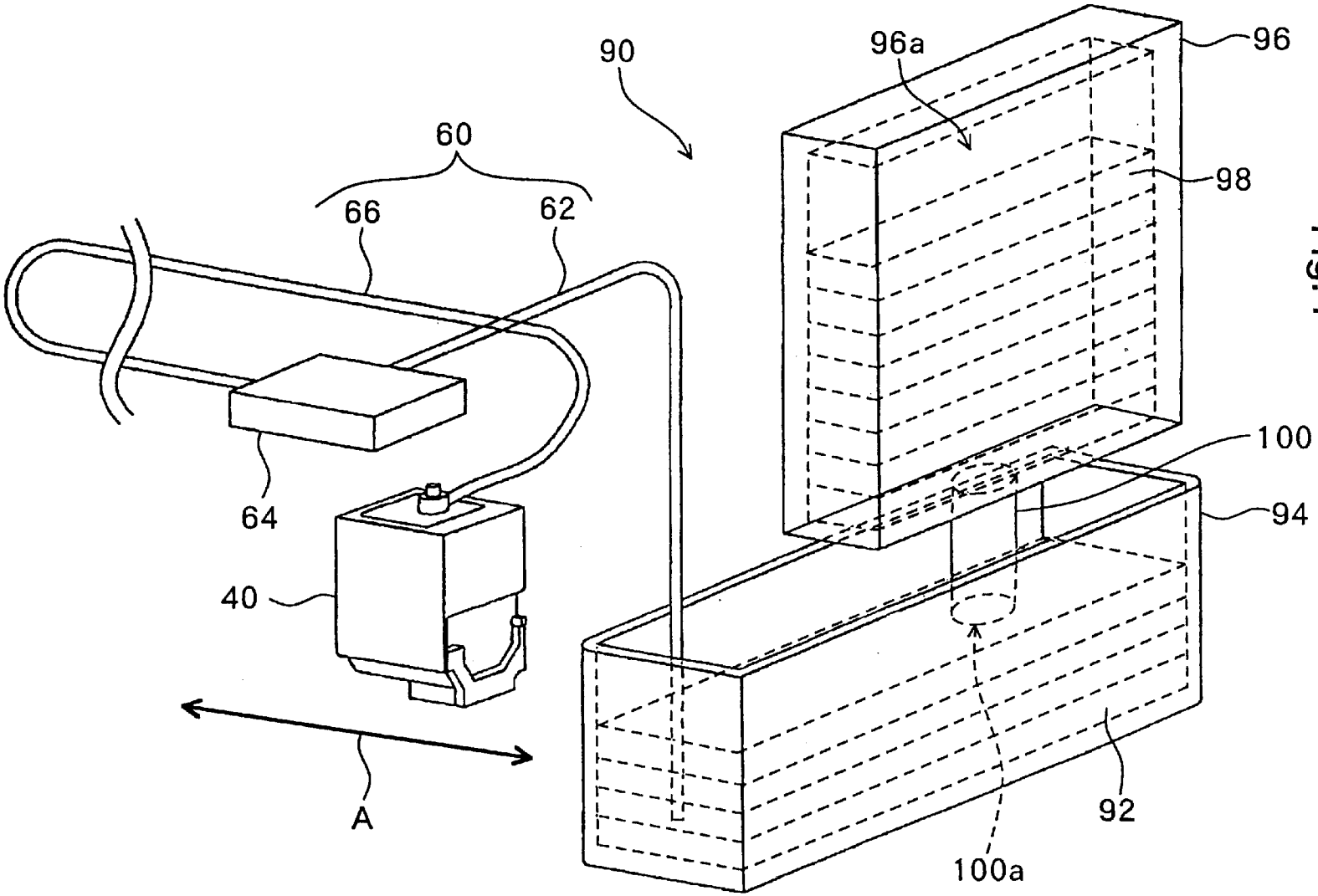
FIG. 4 is a perspective view showing schematically the constitution of an ink supply device of a second embodiment of the present invention.
Figure 5:
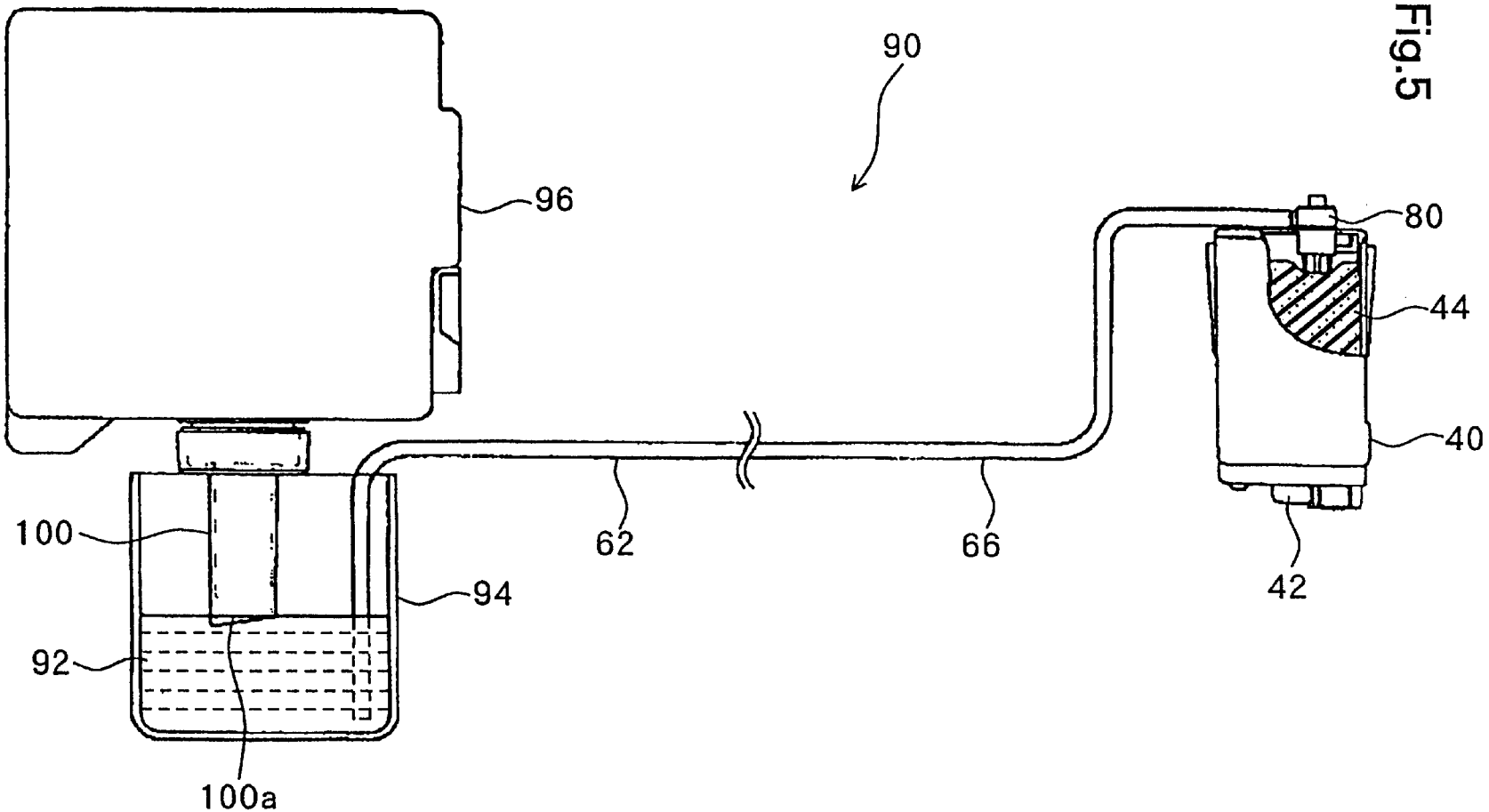
FIG. 5 is a side view of the ink supply device shown in FIG. 4.

FIG. 4 is a perspective view showing roughly the constitution of an ink supply device of a second embodiment of the present invention. FIG. 5 is a side view of the ink supply device shown in FIG. 4. In these drawings, the same symbols and numerals are used for the corresponding constitutional elements as in FIGS. 1–3.

Ink supply device 90 of the second embodiment is characterized by the structure of the ink tank. Ink supply device 90 has an open ink tank 94 in which the surface of stored ink 92 is open to the atmospheric air, and a closed ink tank 96 placed above the open ink tank 94. Closed ink tank 96 stores ink 98 in a closed state. At the middle portion of the bottom wall of closed ink tank 96, a connection pipe 100 is provided which extends vertically to come into contact with ink 92 stored in open ink tank 94.

Open ink tank 94 is positioned such that the liquid surface level of ink 92 in open ink tank 94 is lower than the position of nozzle 42 of printing head 40. Therefore, ink is sucked and fed by the capillary force of an orifice hole (not shown in the drawings) of nozzle 42 from open ink tank 94 through ink supply tube 60 to printing head 40 in correspondence with the ejection of the ink from nozzle 42.

When the liquid surface level of ink 92 is lowered by consumption of ink 92 stored in ink tank 94, air is introduced through connection pipe 100 to the upper space 96*a*, whereby ink is supplied from closed ink tank 96 to open ink tank 94. With elevation of the liquid surface level of ink 92 in open ink tank 94 by supply of the ink, feed opening 100*a* of connection pipe 100 is shut by ink 92 to stop the ink supply from closed ink tank 96 to the open ink tank 94. Thus, the liquid surface level of ink 92 in open ink tank 94 is kept constant by repetition of the above ink supply process. Consequently, the ink is supplied constantly to nozzle 42 to stabilize the amount of the ejected ink without causing deterioration of image quality.

A third embodiment of the present invention is explained by reference to FIGS. 6–11.

Figure 6:
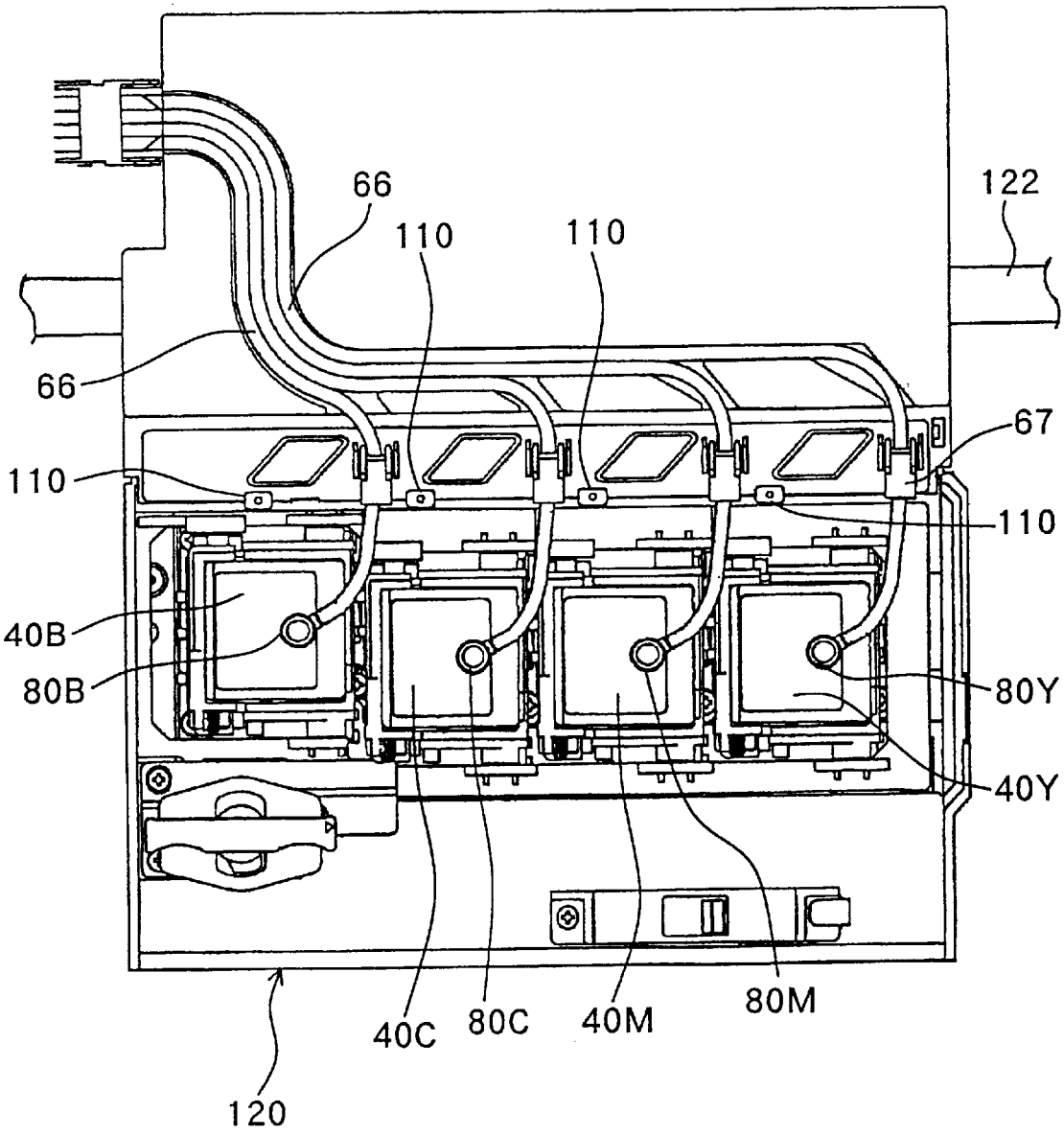
FIG. 6 is a plan view of a carriage with printing heads mounted thereon.
Figure 7:
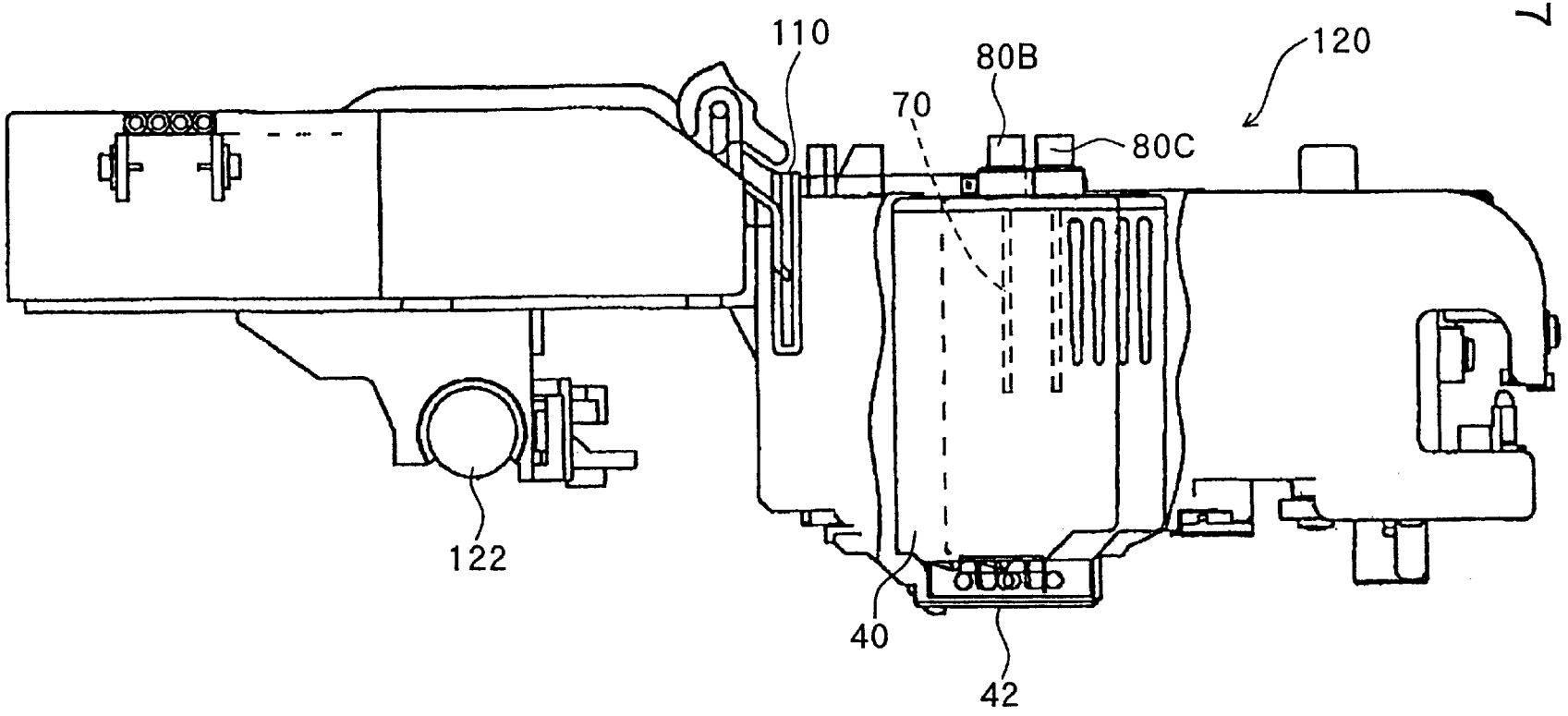
FIG. 7 is a side view of the carriage shown in FIG. 7 with a portion thereof broken away.
Figure 8:
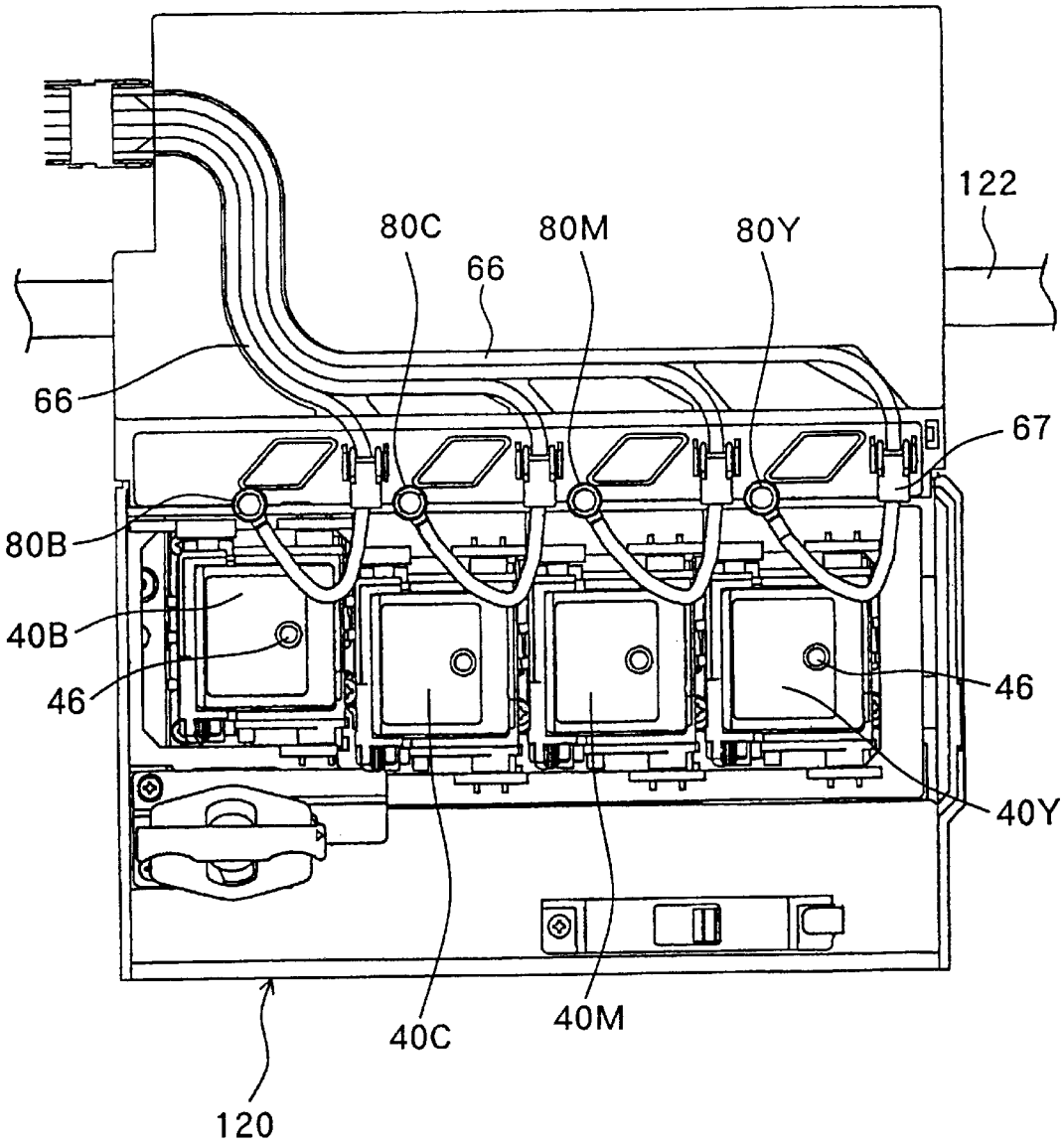
FIG. 8 a plan view of a carriage housing all of the joint members and all of the ink supply pipes in a joint housing room.
Figure 9:
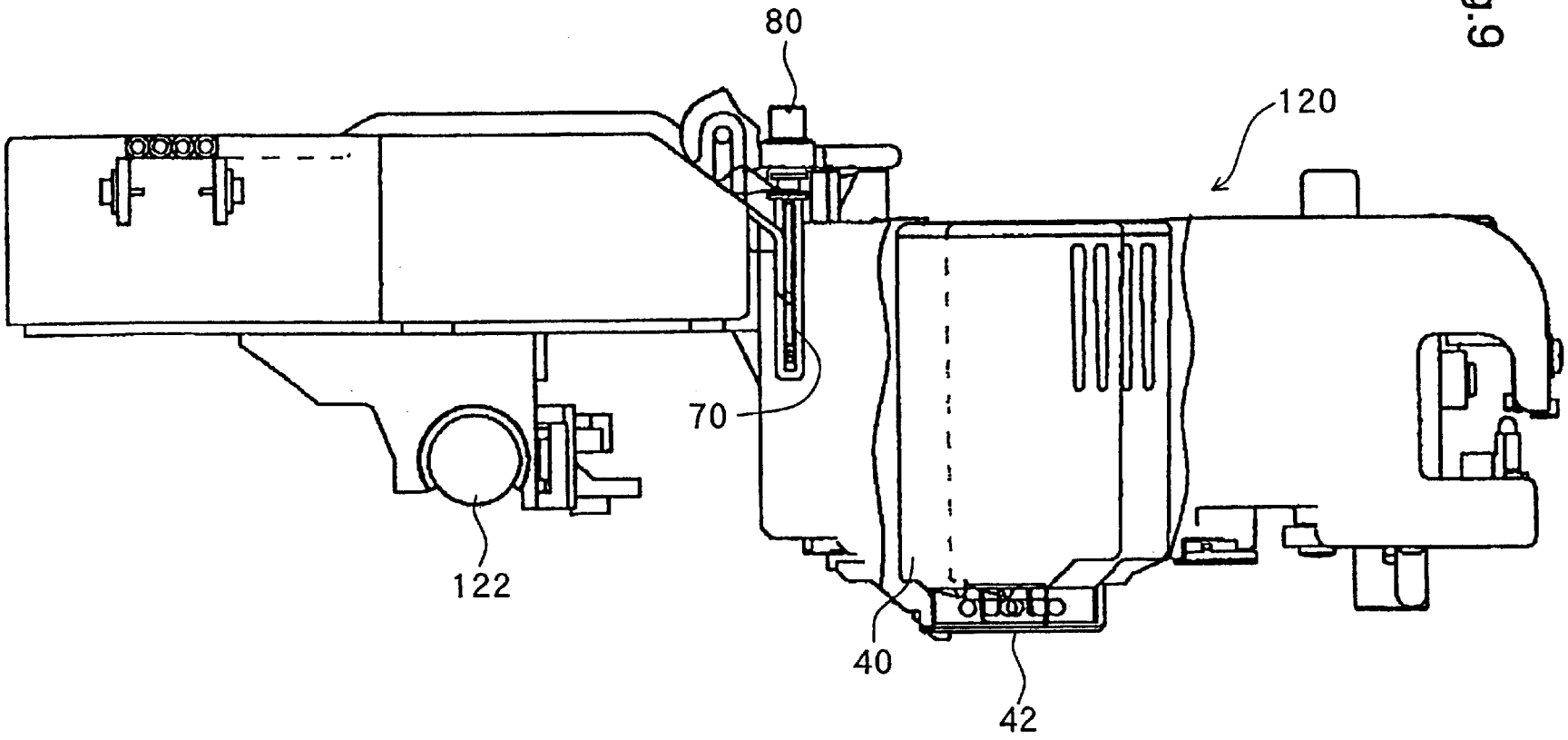
FIG. 9 is a side view of the carriage shown in FIG. 8 with a portion thereof broken away.

FIG. 6 is a plan view of a carriage with printing heads mounted thereon. FIG. 7 is a side view of the carriage with a portion thereof broken away. FIG. 8 is a plan view of a carriage housing all of the joint members and all of the ink supply pipes in a joint housing room. FIG. 9 is a side view of the carriage shown in FIG. 8 with a portion thereof broken away. In these drawings, the same symbols and numerals are used for the corresponding constitutional elements as in FIGS. 1–3.

In the aforementioned first and second embodiments, when ink supply pipe 70 is detached from printing head 40, it may scatter the ink adhering to ink supply pipe 70 to soil the environment, or ink supply tube 60 may be caught by carriage 120 if carriage 120 is reciprocated with ink supply tube 70 separated. To avoid this disadvantage, the ink supply device of the third embodiment is provided with joint housing room 110 in carriage 120 to store joint member 80 and ink supply pipe 70. This joint housing room 110 has a cover to prevent drying of joint housing room 110.

Carriage 120 carries printing heads 40B, 40C, 40M, and 40Y filled respectively with an ink of black, cyan, magenta, or yellow. To printing heads 40B, 40C, 40M, and 40Y, second tubes 66 are connected through joint members 80B, 80C, 80M, and 80Y. Further to joint members 80B, 80C, 80M, and 80Y, ink supply pipes 70 are correspondingly connected. Ink supply tubes 70 are respectively inserted into sponge 44 (see FIG. 2) in printing head 40B, 40C, 40M, or 40Y.

Usually, during printing or waiting, second tubes 66 and printing heads 40 are kept connected tightly by joint member 80 to supply ink from ink tank 50 (see FIG. 1) to printing head 40.

In exchange of printing head 40, joint member 80 and ink supply pipe 70 are detached from printing head 40, and are put into joint housing room 110. Thereby, ink supply pipe 70 having ink adhering thereto is stored entirely in joint housing room 110 to prevent adherence or scatter of ink to surrounding parts, and the tip of second tube 66 is fixed to prevent entanglement of second tube 66 with carriage 120 when the carriage 120 is reciprocated.

Figure 10:
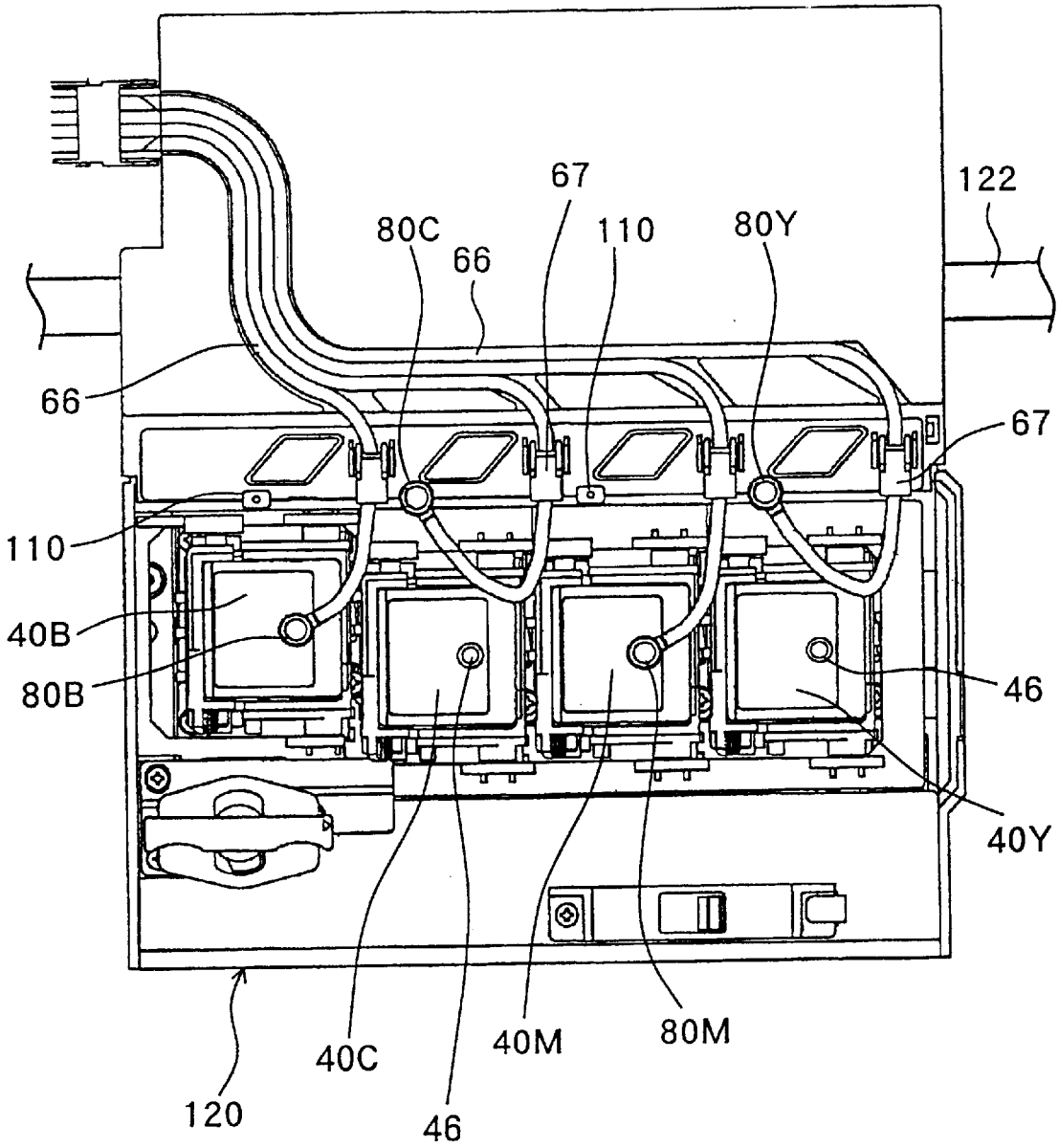
FIG. 10 is a plan view of a carriage housing joint members disconnected from printing head and stored in a joint housing room.
Figure 11:
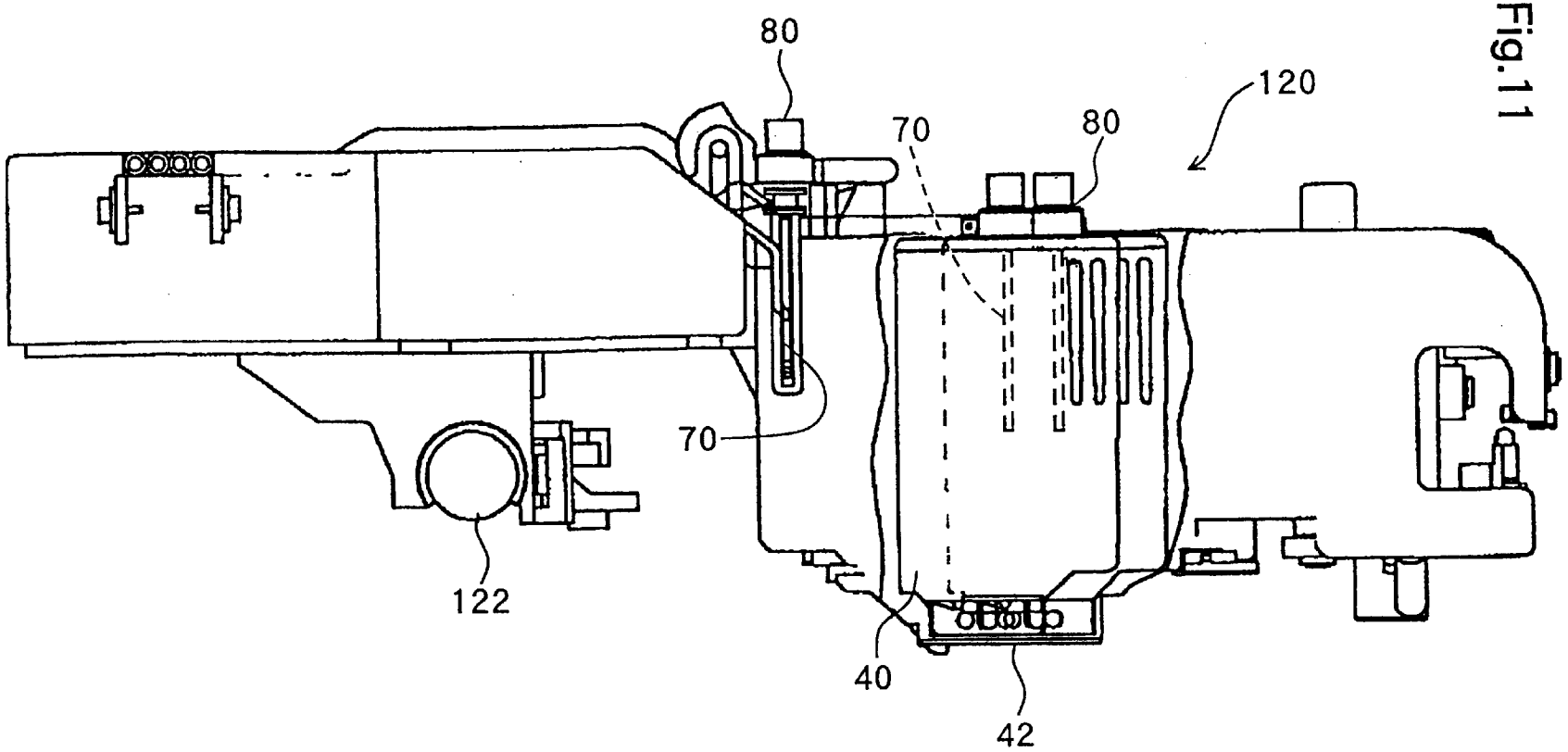
FIG. 11 is a side view of a carriage with a portion thereof broken away.

FIG. 10 is a plan view of a carriage storing the joint members 80C and 80Y detached from printing head 40C or 40Y in joint housing room 110. FIG. 11 is a side view of the carriage with a portion thereof broken away.

As described above, carriage 120 carries printing heads 40B, 40C, 40M, 40Y filled respectively with an ink of black, cyan, magenta, and yellow. In the construction of carriage 120, printing head 40B filled with a black ink is displaced by the distance of the breadth of the printing head nozzle. Therefore, by mounting another printing head 40B filled with the black ink additionally in the position of printing head 40C, black color can be printed at double the speed. In this case, valve 67 of second tube 66 connected to printing head 40C is closed, and joint member 80C is disconnected from printing head 40C and is stored in joint housing room 110. Thus, by providing joint member 80 to be disconnectable arbitrarily, another printing head which is not connected to the ink supply tube can also be used. By providing joint housing room 110 and storing the joint member 80 in joint housing room 110, any color other than conventional black, cyan, magenta, and yellow, such as fluorescent color, can be used for the printing. Otherwise, second tube 66 may be branched into several tubes to supply an ink from one second tube to plural printing heads.

A fourth embodiment of the present invention is explained by reference to FIGS. 12–16.

Figure 12:
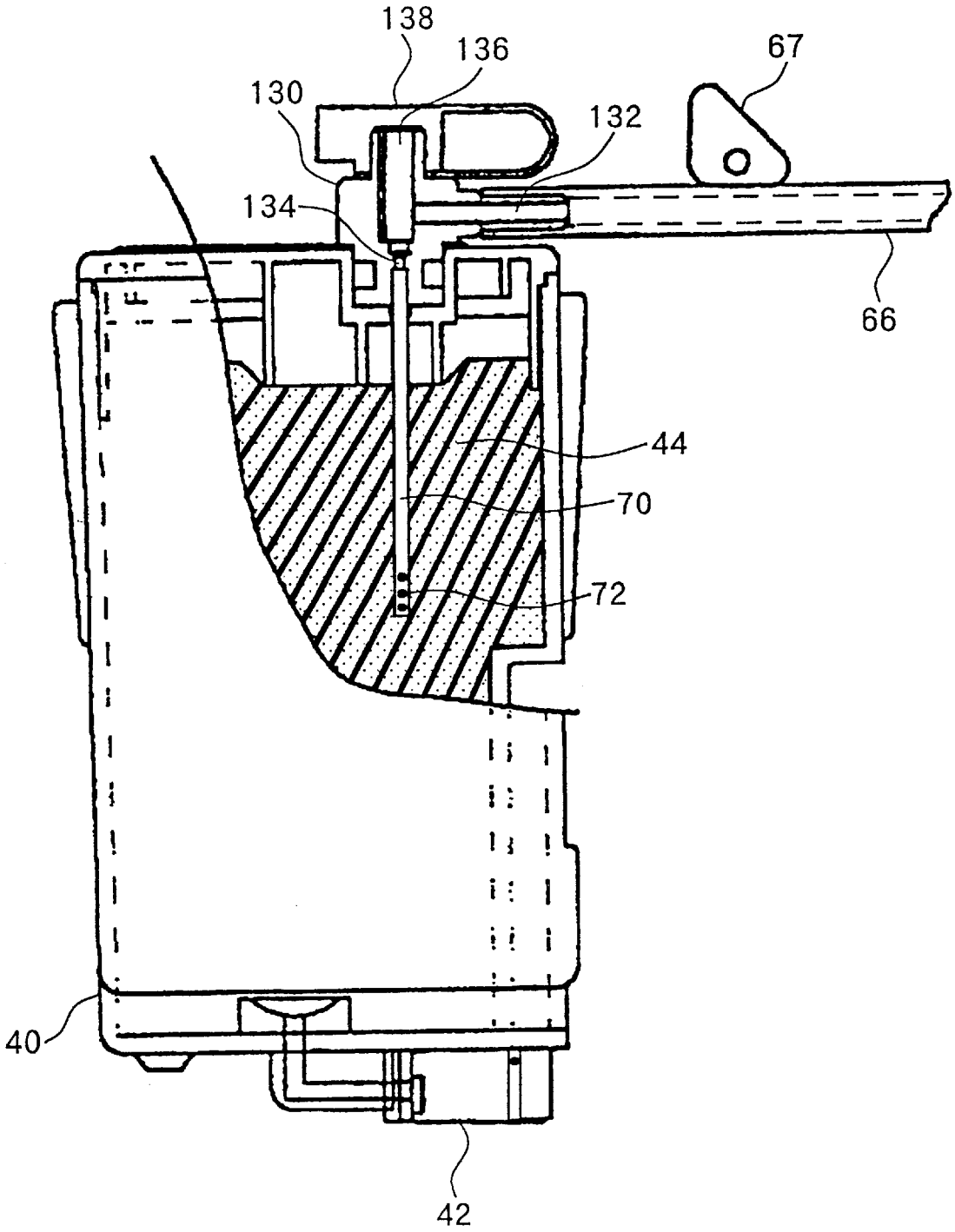
FIG. 12 illustrates a state in which a joint member is capped and no ink is filled yet in the second tube.
Figure 13:
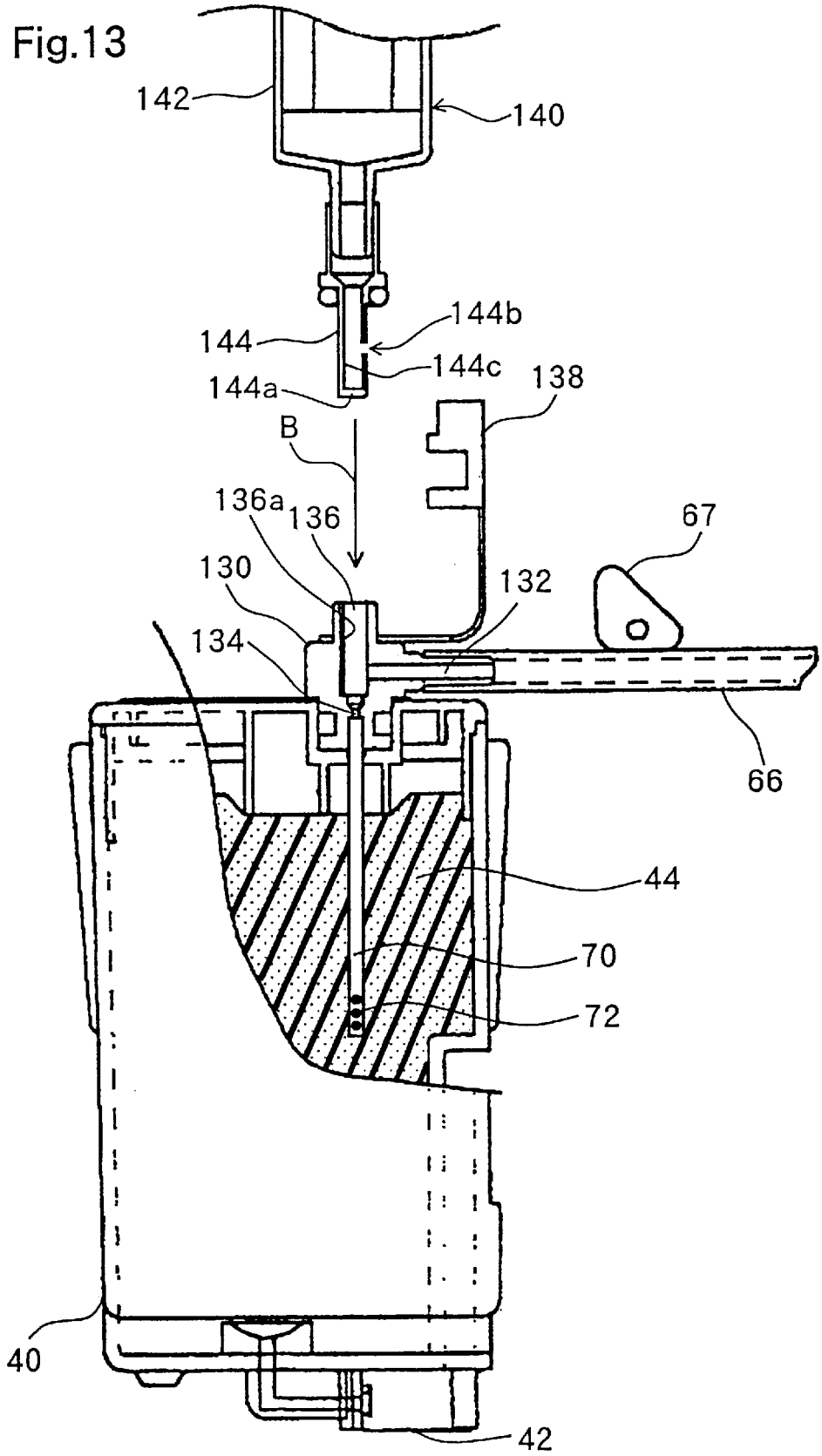
FIG. 13 illustrates a state in which the joint member is uncapped.
Figure 14:
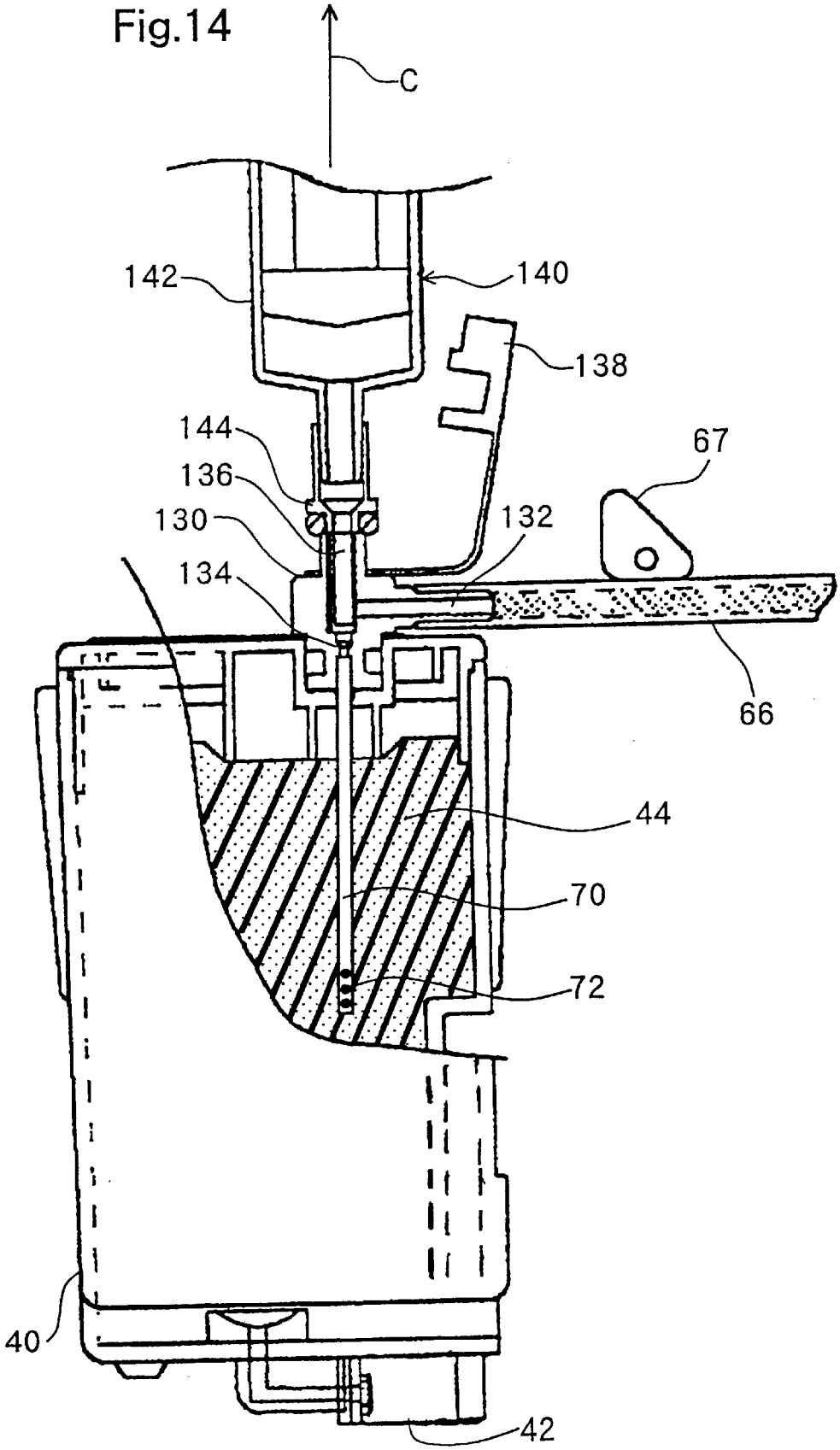
FIG. 14 illustrates a state in which a sucking device is connected to the third connection orifice of the joint member.
Figure 15:
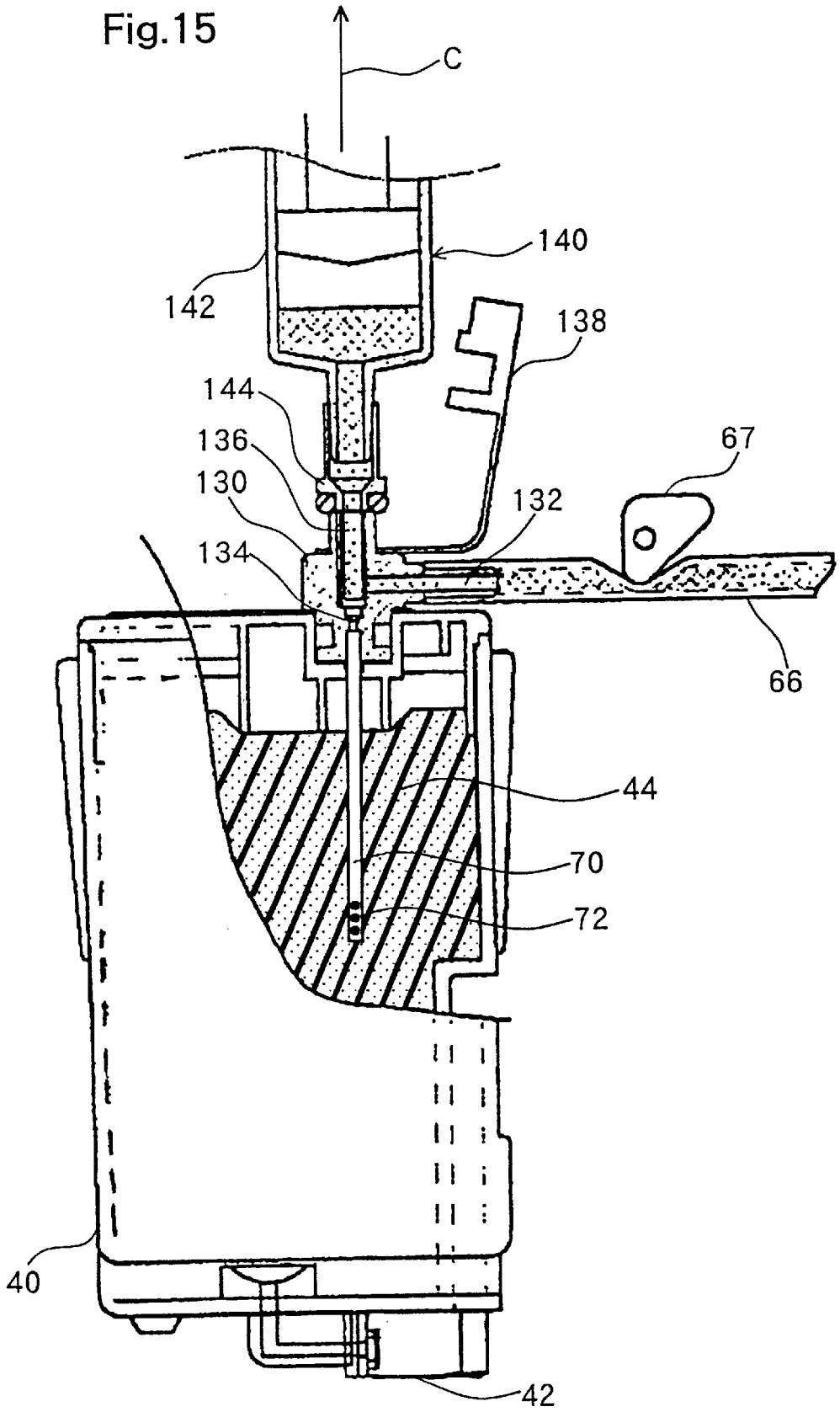
FIG. 15 illlustrates a state of filling an ink with the sucking device into the second tube.
Figure 16:
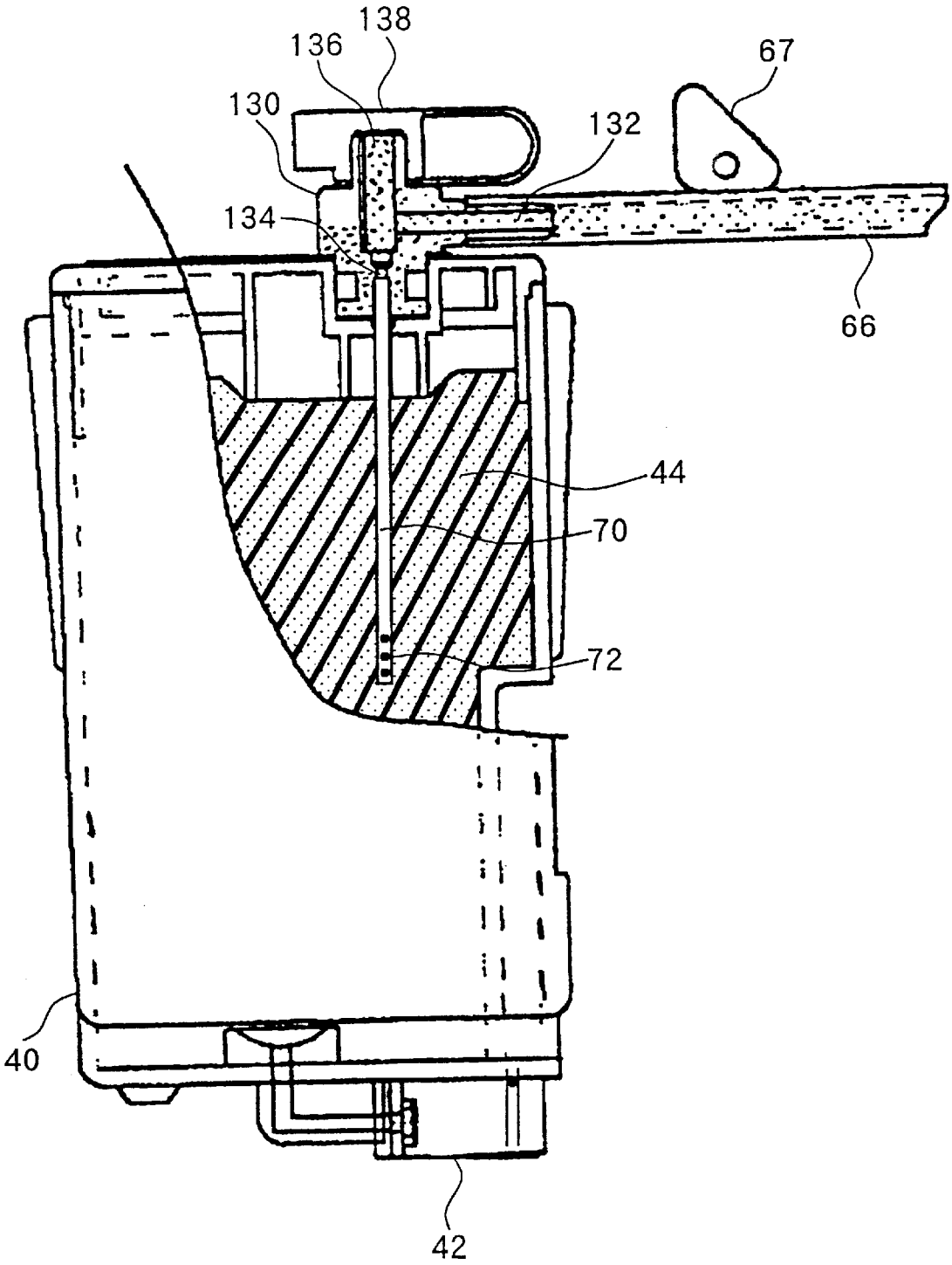
FIG. 16 illustrates a state in which the cap is put on after completion of ink filling into the second tube.
Figure 17:
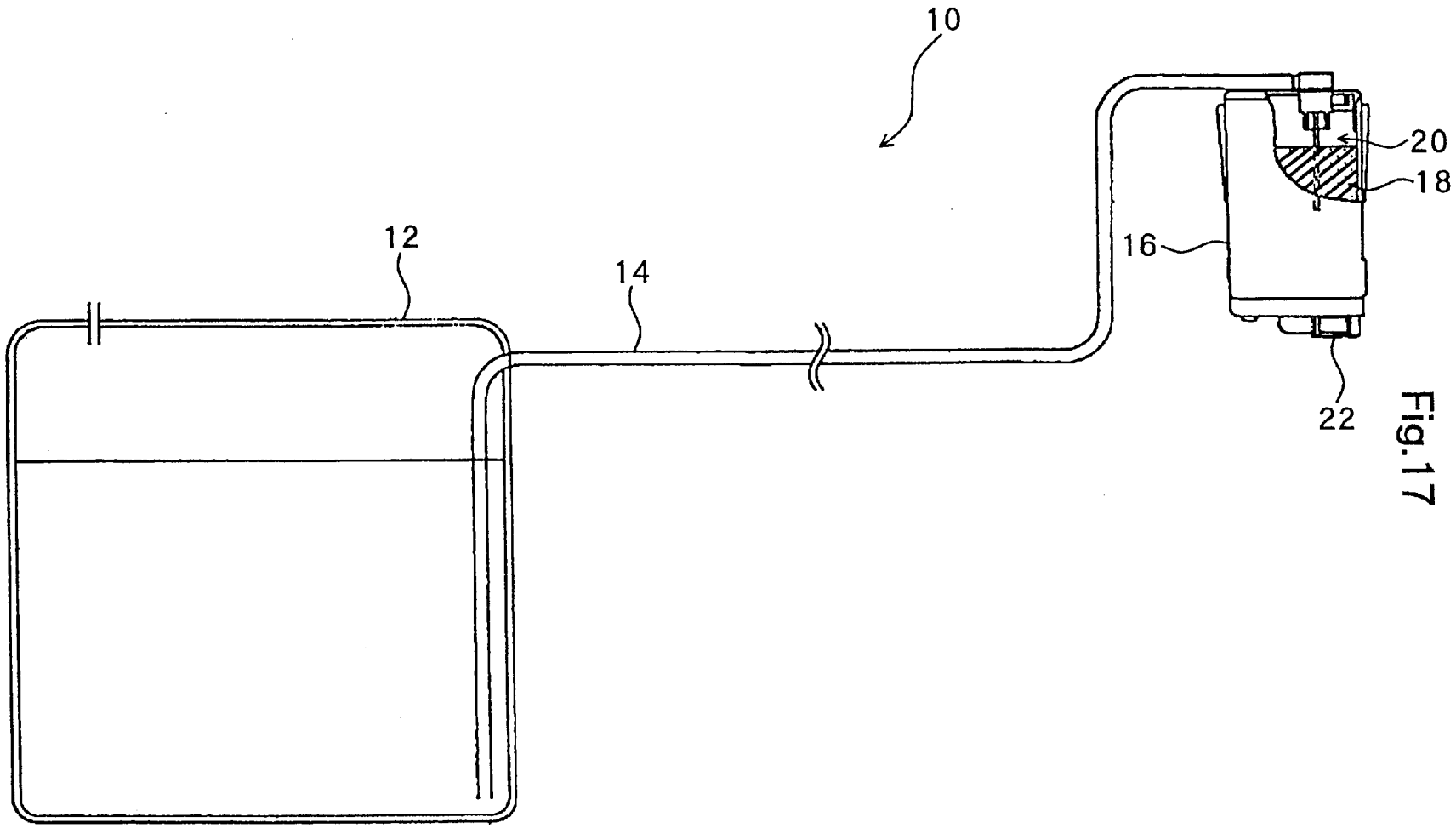
FIG. 17 is a perspective view showing roughly a constitution of a conventional ink supplying device.

FIGS. 12–16 illustrate a joint member connected to a printing head. FIG. 12 illustrates a state in which a joint member is capped and no ink is filled yet in second tube 66. FIG. 13 illustrates a state in which the joint member is uncapped. FIG. 14 illustrates a state in which a sucking device is connected to the third connection orifice of the joint member. FIG. 15 illustrates a state of filling an ink into second tube 66 with the sucking device. FIG. 16 illustrates a state in which the cap is put on after completion of ink filling into second tube 66. In these drawings, the same symbols and numerals are used for the corresponding constitutional element as in FIGS. 1–3.

Joint member 130 has first connection orifice 132 for connection with the end of second tube 66, second connection orifice 134 for connection with ink supply tube 70, and third connection orifice 136 for connection of sucker 140 for sucking an ink. Thus, joint member 130 has a structure like a three-way valve. Joint member 130 has also a cap 138 for closing and opening third connection orifice 136.

Sucker 140 has syringe 142 for generating a negative pressure, and ink filling adapter 144 at the tip of this syringe 142. Tip 144*a* of ink filling adapter 144 in the insertion direction is closed and a lateral hole 144*b* is formed a little above tip 144*a*. Therefore, on insertion of ink filling adapter 144 into third connection orifice 136, lateral hole 144*b* and second tube 66 are communicated with each other, and second connection orifice 134 is closed.

In the step of filling the ink for the first time from ink tank 50 (see FIG. 1) into ink supply tube 60, cap 138 is removed, and syringe 142 having ink filling adapter 144 is inserted in arrow-B direction as shown in FIG. 13. Thereby, sucker 140 (syringe 142) is connected to first and third connection orifices 132,136 but is not connected to second connection orifice 134. On the wall of third connection orifice 136, at the portion counter to the first connection orifice, groove 136*a* is formed, while ink filling adapter 144 has rib 144*c* to fit to this groove 136*a*. Therefore, on insertion of ink filling adapter 144 into third connection orifice so as to fit rib 144*c* into groove 136*a*, lateral hole 144*b* is surely communicated with second tube 66.

With ink filling adapter 144 connected to third connection orifice 136, the ink is sucked from ink tank 50 by generating a negative pressure with syringe 142 as shown in FIG. 14. Thereby, as shown in FIG. 15, the ink is filled in second tube 66 and first tube 62 (see FIG. 1), namely ink supply tube 60. When the ink has been filled in ink supply tube 60, valve 67 is closed to prevent backward ink flow caused by water head difference between the surface level of ink 52 in ink tank 50 and nozzle 42. Thereafter, cap 138 is put on, and valve 67 is opened. In such a manner, by use of joint member 130 and sucker 140, the initial ink filling can be conducted simple and rapidly, which renders the ink supply device readily handleable.

INDUSTRIAL APPLICABILITY

In the ink supply device of the present invention, as described above, the printing head contains therein a porous mass having open-cell structure and being connected to a nozzle, and the porous mass is connected to an ink supply tube. Thereby, the amount of ejection of ink is stabilized to prevent deterioration of image quality which will be caused by variation of the amount of the ink ejection from the nozzle.

The amount of the ink ejection from the nozzle is stabilized more by use of an ink supply pipe additionally provided which is connected to the end of the ink supply tube and is inserted into the porous body, whereby the ink can be supplied efficiently to the porous body.

The tip of the ink supply pipe is inserted preferably into the center portion of the porous mass or a portion nearer to the nozzle to stabilize still more the amount of the ink ejection from the nozzle.

The ink supply pipe has preferably ink-discharging holes on the side wall thereof to supply the ink stably and smoothly even when the tip of the ink supply pipe is clogged with the porous mass.

The porous mass is preferably capable of absorbing pressure variation in the ink supply tube by its capillarity to prevent instability of the amount of the ink ejection which will be caused by pressure variation.

The ink tank comprises preferably an open ink tank which contains the ink with the surface of the ink open to the atmospheric air; and a closed ink tank placed above the open ink tank, storing the ink in a closed state, and having a connection pipe extending vertically to come into contact with the ink stored in the open ink tank. Thereby, the surface level of the stored ink in the open ink tank is kept constant to render constant the supply of the ink to the nozzle to stabilize the ink ejection from the nozzle without deteriorating the image quality.

The open ink tank is preferably placed such that the surface level of the stored ink is lower than the position of the nozzle of the printing head. Thereby, the ejection of the ink from the nozzle is stabilized more.

The ink supply device has preferably a joint member which is attached to the tip end of the ink supply tube and connects the ink supply tube detachably and hermetically to the printing head. Thereby, the ink supply tube is readily be connected to the printing head.

The ink supply device has preferably a joint housing room for storing the joint in the carriage. Thereby, scatter of the ink adhering to the joint member is prevented when the joint member is disconnected from the printing head.

The joint housing room is preferably provided in the same number as the number of the joint members connected to the printing head mounted on the carriage. Thereby, scatter of the ink adhering to any of the joint members is prevented when the joint member is disconnected from the printing head.

The ink supply device has preferably a cover for covering the joint housing room. Thereby, drying of the joint housing room is prevented.

The joint member has preferably a first connection orifice for connection with the tip portion of the ink supply tube, a second connection orifice for connection of the ink supply pipe, and a third connection orifice separated from the first and second orifices. By providing a sucking device for sucking the ink to be connected with the third connection orifice, the ink can be readily be filled into the unfilled ink supply tube by sucking the ink with the sucking device through the third connection orifice.

By employing an ink-filling adapter which communicates with the first connection orifice and does not communicate with the second connection orifice, the ink can be surely filled into the unfilled ink supply tube.

Further, with a groove formed on the third connection orifice, and a rib formed on the ink-filling adapter, the ink-filling adapter can be inserted surely by fitting the rib into the groove.

The ink filling method of the present invention comprises ink filling steps: connecting a sucking device for ink sucking to the third connection orifice, closing the second joint orifice of the joint member, and filling the ink into the ink supply tube by sucking with the sucking device. Thereby, the ink can be filled smoothly into the ink supply tube.

What is claimed is:

1. An ink supply device of an ink-jet type image formation apparatus having a carriage reciprocating in a prescribed direction and forming an image by ejection of ink on a recording medium, comprising a printing head having a nozzle and being mounted on the carriage, an ink tank for storing the ink to be supplied to the printing head, and an ink supply tube for supplying ink from the ink tank to the printing head, wherein the printing head contains a built-in porous mass of an open-cell structure communicating with the nozzle, and the ink supply tube is connected at the one end to the porous mass hermetically, wherein an ink supply pipe is provided which is connected to the one end of the ink supply tube and is inserted into the porous mass, wherein the tip of the ink supply pipe is inserted into the center portion of the porous mass or into the portion thereof nearer to the nozzle than the center portion, wherein the ink supply pipe has an ink discharging through-hole on the side wall thereof, and wherein the ink tank comprises an open tank in which the whole liquid ink surface is open to the atmosphere, a connection pipe in contact with the ink in the open tank and extending upward therefrom, and a closed ink tank placed above the open ink tank and storing the ink in a closed state.

2. The ink supply device according to claim 1, wherein the porous mass is capable of absorbing pressure variation in the ink supply tube by capillarity.

3. The ink supply device according to claim 2, wherein a joint member is provided which is attached to the tip end of the ink supply tube and connects the ink supply tube detachably and hermetically to the printing head.

4. An ink supply device according to claim 3 further comprises a plurality of said ink discharging through-hole.

5. An ink supply device according to claim 2 further comprises a plurality of said ink discharging through-hole.

6. The ink supply device according to claim 1, wherein the open ink tank is placed such that the surface level of the ink is lower than the position of the nozzle of the printing head.

7. The ink supply device according to claim 6, wherein a joint member is provided which is attached to the tip end of the ink supply tube and connects the ink supply tube detachably and hermetically to the printing head.

8. An ink supply device according to claim 7 further comprises a plurality of said ink discharging through-holes.

9. An ink supply device according to claim 6 further comprises a plurality of said ink discharging through-hole.

10. The ink supply device according to claim 1, wherein a joint member is provided which is attached to the tip end of the ink supply tube and connects the ink supply tube detachably and hermetically to the printing head.

11. An ink supply device according to claim 10 further comprises a plurality of said ink discharging through-hole.

12. An ink supply device according to claim 1 further comprises a plurality of said ink discharging through-hole.

* * * * *